US011241739B2

(12) United States Patent
Zhang et al.

(10) Patent No.: US 11,241,739 B2
(45) Date of Patent: Feb. 8, 2022

(54) PREPARATION METHOD FOR GOLD NANOPARTICLES BASED ON FUNCTIONALIZED IONIC LIQUID

(71) Applicant: DONGGUAN UNIVERSITY OF TECHNOLOGY, Dongguan (CN)

(72) Inventors: Min Zhang, Dongguan (CN); Baosong Dai, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 275 days.

(21) Appl. No.: 16/438,126

(22) Filed: Jun. 11, 2019

(65) Prior Publication Data

US 2020/0114430 A1 Apr. 16, 2020

(51) Int. Cl.
*B22F 9/24* (2006.01)

(52) U.S. Cl.
CPC ..... *B22F 9/24* (2013.01); *B22F 2009/245* (2013.01); *B22F 2202/17* (2013.01); *B22F 2301/255* (2013.01); *B22F 2304/054* (2013.01)

(58) Field of Classification Search
None
See application file for complete search history.

(56) References Cited

U.S. PATENT DOCUMENTS

2009/0027611 A1* 1/2009 Hegmann ..... C07C 323/12 349/182
2011/0062385 A1* 3/2011 Hegmann ..... C09K 19/2007 252/299.65
2016/0199875 A1* 7/2016 Crudden ..... B05D 1/18 427/249.1
2020/0239781 A1* 7/2020 Hirst ..... C08K 3/10

OTHER PUBLICATIONS

Bhattacharya, S. et al., "Synthesis of gold nanoparticles stabilised by metal-chelator and the controlled formation of close-packed aggregates by them", Proceedings of the Indian Academy of Sciences (Chem. Sci.), vol. 115, Nos. 5 and 6, Oct.-Dec. 2003, pp. 613-619.*

* cited by examiner

*Primary Examiner* — George Wyszomierski
(74) *Attorney, Agent, or Firm* — Hawaii Patent Services; Nathaniel K. Fedde

(57) ABSTRACT

The present invention provides a preparation method for gold nanoparticles based on functionalized ionic liquid. The method comprises synthesizing a functionalized ionic liquid, 3-(12-bromo-dodecyl)-1-(3-pyrrole propyl)-imidazole bromide, as a stabilizer for synthesizing gold nanoparticles, adjusting the concentration of the ionic liquid and the dosage of the reducing agent, thereby successfully preparing the icosahedral gold nanoparticles, and characterizing the morphology thereof by TEM, XRD and SEM. In the present invention, the method employed for preparing the stabilizer is simple, non-toxic, harmless and pollution-free, moreover the preparation of gold nanoparticles by aqueous phase has the advantages of mild conditions, short reaction time, simple operation, green and pollution-free, and belongs to the environment-friendly preparation.

6 Claims, 6 Drawing Sheets

PREPARATION METHOD FOR GOLD NANOPARTICLES BASED ON FUNCTIONALIZED IONIC LIQUID

TECHNICAL FIELD

The present invention belongs to the field of gold nanoparticles material research, specifically to a rapid and environmentally friendly preparation method for gold nanoparticles based on functionalized ionic liquid.

BACKGROUND TECHNOLOGY

The imidazolyl Ionic liquid, compared with conventional Ionic liquids, has better stability in air, water and electrochemical tests, and has a wider temperature range in liquid state. It could be employed as a stabilizer to modify the morphology of noble metal nanoparticles and perform group modification on the surface of the noble metal nanoparticles. The functionalized ionic liquids for modifying the nanoparticles often comprise mercapto, carboxyl, amino and hydroxyl groups, due to the presence of these groups, nanoparticles could be more easily dispersed in the solution. And because these different groups produce different electrostatic repulsion, it is possible to generate different spacing between the nanoparticles.

The gold nanoparticle has obvious surface effect, volume effect, quantum effect, small size effect and macroscopic quantum tunneling effect. Its optical properties, electronic properties, sensing properties and biochemical properties have become the current hotspots of research, and have been widely employed in the fields of supramolecule, biochemistry, nanoelectronics, optoelectronics, catalysis and biomedicine.

Since the size and shape of the gold nanoparticles are the important factors in determining performance thereof, to precise control of particle size and morphology becomes the key to prepare nanoparticles of high-performance, and is also a prerequisite for material properties research and device development. The performance of these devices largely depends on the size, morphology and assembly of the gold nanoparticle structural unit. At present, many methods for preparing gold nanoparticles have been developed. Liquid phase reduction method has been the most classical method so far and mainly employs reducing agent to reduce the chloroauric acid solution. The reducing agent like sodium citrate, sodium borohydride, ascorbic acid, etc. is mostly employed. Conventional preparation methods generally employ surfactants and adjust the dosage of reducing agent to regulate the morphology and size of gold nanoparticles. Such kind protective agent is prone to cause interference in gold nanoparticle applications so as to limit the application range of gold nanoparticles.

SUMMARY OF THE INVENTION

In view of aforesaid issues existing in the current technology, the present invention aims at providing a simple and effective preparation method for gold nanoparticles based on functionalized ionic liquid.

In order to realize aforesaid purpose, the present invention employs following technical solutions:

A functionalized ionic liquid, 3-(12-bromo-dodecyl)-1-(3-pyrrole-propyl)-imidazole bromide is prepared as following method of:

(1) dissolving 0.01 mol of imidazole in 20 mL of anhydrous acetonitrile and stirring in an ice bath at 0° C. to obtain a mixture, and adding 0.015 mol of sodium hydride to the mixture for 1 hour reaction, then adding 50 ml of acetonitrile solution containing 0.005 mol of 1, 12-dibromododecane to the mixture, and heating the mixture to reflux at 65° C. for 12 hours, thereby obtaining a yellow N-(12-bromo-dodecyl)-imidazole liquid.

(2) dissolving 1 mmol of N-(12-bromo-dodecyl) imidazole and 1.1 mmol of 1-(3-bromopropyl) pyrrole in 30 mL of toluene to react under the protection of nitrogen at 80°C. for 24 hours, thereby obtaining a light yellow oily 3-(12-bromo-dodecyl)-1-(3-pyrrol-propyl)-imidazole bromide ionic liquid.

The present invention further provides a preparation method for the gold nanoparticles comprising following steps of:

S1, seeded synthesis of gold nanoparticles: putting 0.42 mL of 0.002 mol/L HAuCl4 solution into 0.951 mL of secondary distilled water and blending to obtain a mixture, then adding 1.25 mL of 0.20~0.40 mol/L 3-(12-bromo-dodecyl)-1-(3-pyrrol-propyl)-imidazole bromide solution and 0.5 mL of new preparative 0.01 mol/L NaBH4 solution to the mixture for standing at 27° C. for 2~4 hours, thereby obtaining the gold nanoparticle seeds, and storing the gold nanoparticle seeds at 4° C. for later use;

S2, synthesis of gold nanoparticles: sequentially putting 2.6 mL of secondary distilled water, 1.67 mL of 2×10−3 mol/L HAuCl4 solution, 3.96 mL of 0.4~0.6 mol/L 3-(12-bromo-dodecyl)-1-(3-pyrrol-propyl) imidazole bromide solution and 54 μL of 0.1 mol/L ascorbic acid solution into the test tube and obtaining a mixture, and stirring the mixture vigorously for 2 minutes, lastly adding 100~150 μL of the gold nanoparticle seeds prepared in S1 to the mixture and stirring, after stirring the mixture for 20~40 seconds and standing the mixture for 12~24 hours at 25~30° C., thereby obtaining a gold nanoparticles solution.

S3, centrifuging the gold nanoparticles solution obtained in S2 to collect the gold nanoparticle solids, then washing the gold nanoparticle solids with water and centrifuging again to collect the obtained gold nanoparticle solids.

Preferentially, the preparation method for the gold nanoparticles, in which the concentration of the 3-(12-bromo-dodecyl)-1-(3-pyrrol-propyl)-imidazole bromide solution in S1 is 0.25 mol/L.

Preferentially, the preparation method for the gold nanoparticles, in which the concentration of the 3-(12-bromo-dodecyl)-1-(3-pyrrol-propyl)-imidazole bromide solution in S2 is 0.50 mol/L.

Preferentially, the preparation method for the gold nanoparticles, in which the 120 μL of gold nanoparticle seeds prepared in S1, is added in S2.

Preferentially, the preparation method for the gold nanoparticles, in which the standing temperature in S2 is kept at 27° C. for 24 h to obtain the gold nanoparticles solution.

Preferentially, the preparation method for the gold nanoparticles, in which the gold nanoparticles solution in S3 is centrifuged at a rate of 12000 r/min for 8~10 minutes to be divided into two layers, the upper liquid layer is removed and the lower solid layer is dispersed again in the water for a second centrifugation to obtain the gold nanoparticle solids.

Compared with prior art, the present invention has following beneficial effects:

(1) In the present invention, the imidazole group is substituted by dibromoalkanes and reacts with bromopropylpyrrole to form a 3-(12-bromo-dodecyl)-1-(3-pyrrol-propyl)-imidazole bromide ionic liquid in which one side chain thereof comprising bromine atom and the other side chain thereof comprising the pyrrole group with its anion being bromine ion, then the 3-(12-bromo-dodecyl)-1-(3-pyrrol-propyl)-imidazole bromide ionic liquid is employed as a morphology regulating agent and the ascorbic acid is a reducing agent. By means of adjusting the concentration of the Ionic liquid and the dosage of the reducing agent to certain amounts, and optimizing the reaction time, the icosahedral gold nanoparticles with uniform size is successfully prepared by seed growth method.

(2) The present invention provides new ideas for the functionalized ionic liquid as a stabilizer to modify the morphology of the noble metal nanoparticles and perform group modification on the surface of the noble metal nanoparticles, moreover the preparation method of the present invention is simple, green and environmentally friendly, and indicates a new development direction for the synthesis and regulation of metal morphology.

SPECIFIC EMBODIMENTS

In order to make the purpose, technical solutions and advantages of the present invention more clear and obvious, the present invention will be further illustrated in detail in combination with accompanying figures and embodiments hereinafter. It should be understood that the specific embodiments illustrated herein are only to explain the present invention but not to limit, unless otherwise specified, the reagents, methods and equipment employed in the present invention are conventional reagents, methods and devices in the technical field.

The present invention is further illustrated in combination with the specific implementation method below.

Embodiment 1

Figure 1:
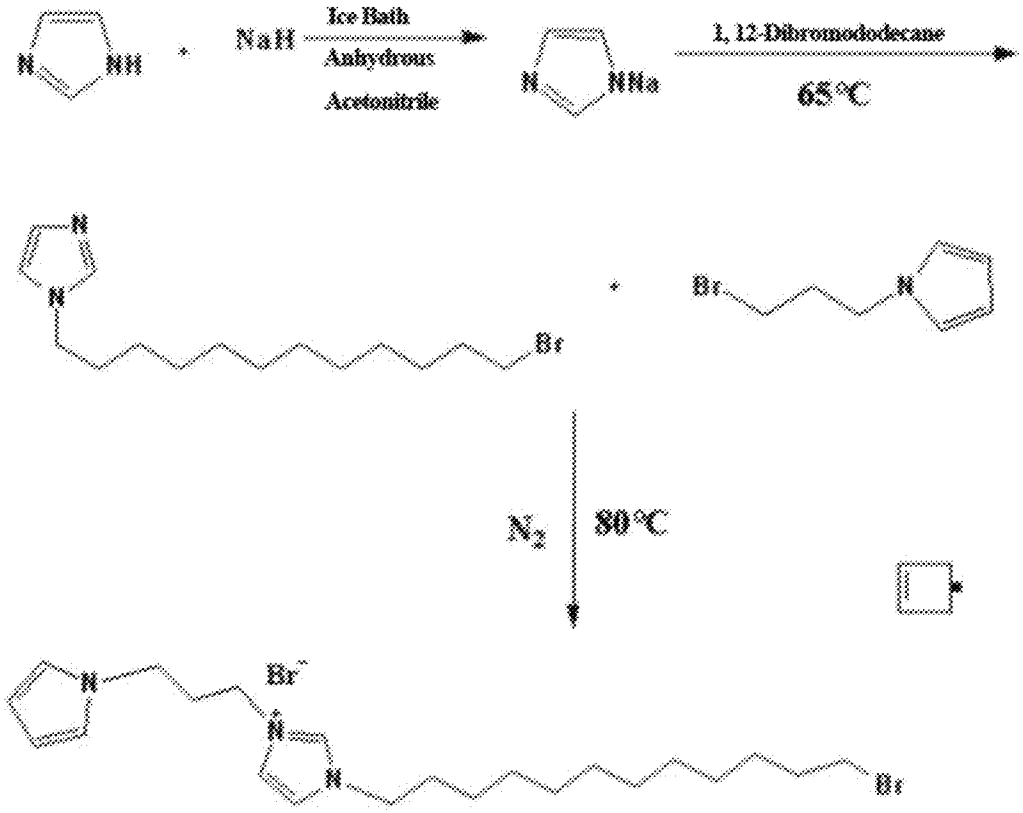
FIG. 1 shows the synthetic routes of 3-(12-bromo-dodecyl)-1-(3-pyrrol-propyl)-imidazole bromide.

As shown in FIG. 1, a functionalized ionic liquid, 3-(12-bromo-dodecyl)-1-(3-pyrrole-propyl)-imidazole bromide is prepared as following method of:

(1) dissolving 0.01 mol of imidazole in 20 mL of anhydrous acetonitrile and stirring in an ice bath at 0° C. to obtain a mixture, and adding 0.015 mol of sodium hydride to the mixture for 1 hour reaction, then adding 50 ml of acetonitrile solution containing 0.005 mol of 1,12-dibromododecane to the mixture, and heating the mixture to reflux at 65° C. for 12 hours, thereby obtaining a yellow N-(12-bromo-dodecyl)-imidazole liquid.

(2) dissolving 1 mmol of N-(12-bromo-dodecyl) imidazole and 1.1 mmol of 1-(3-bromopropyl) pyrrole in 30 mL of toluene to react under the protection of nitrogen at 80°C. for 24 hours, thereby obtaining a light yellow oily 3-(12-bromo-dodecyl)-1-(3-pyrrol-propyl)-imidazole bromide ionic liquid.

Dissolving 20 mg of aforesaid synthesized 3-(12-bromo-dodecyl)-1-(3-pyrrole-propyl)-imidazole bromide ionic liquid in the deuterochloroform to be detected by 1HNMR. 1HNMR(400 MHz, D2O)δ: 8.396(1H,d), 7.37(2H,d), 6.69 (2H,d), 6.08(2H,d), 4.08(2H,t), 4.03(2H,t), 3.98(2H,t), 3.03 (2H,t), 2.32(2H,t), 2.00(2H,t), 1.135(18H,t).

Figure 2:
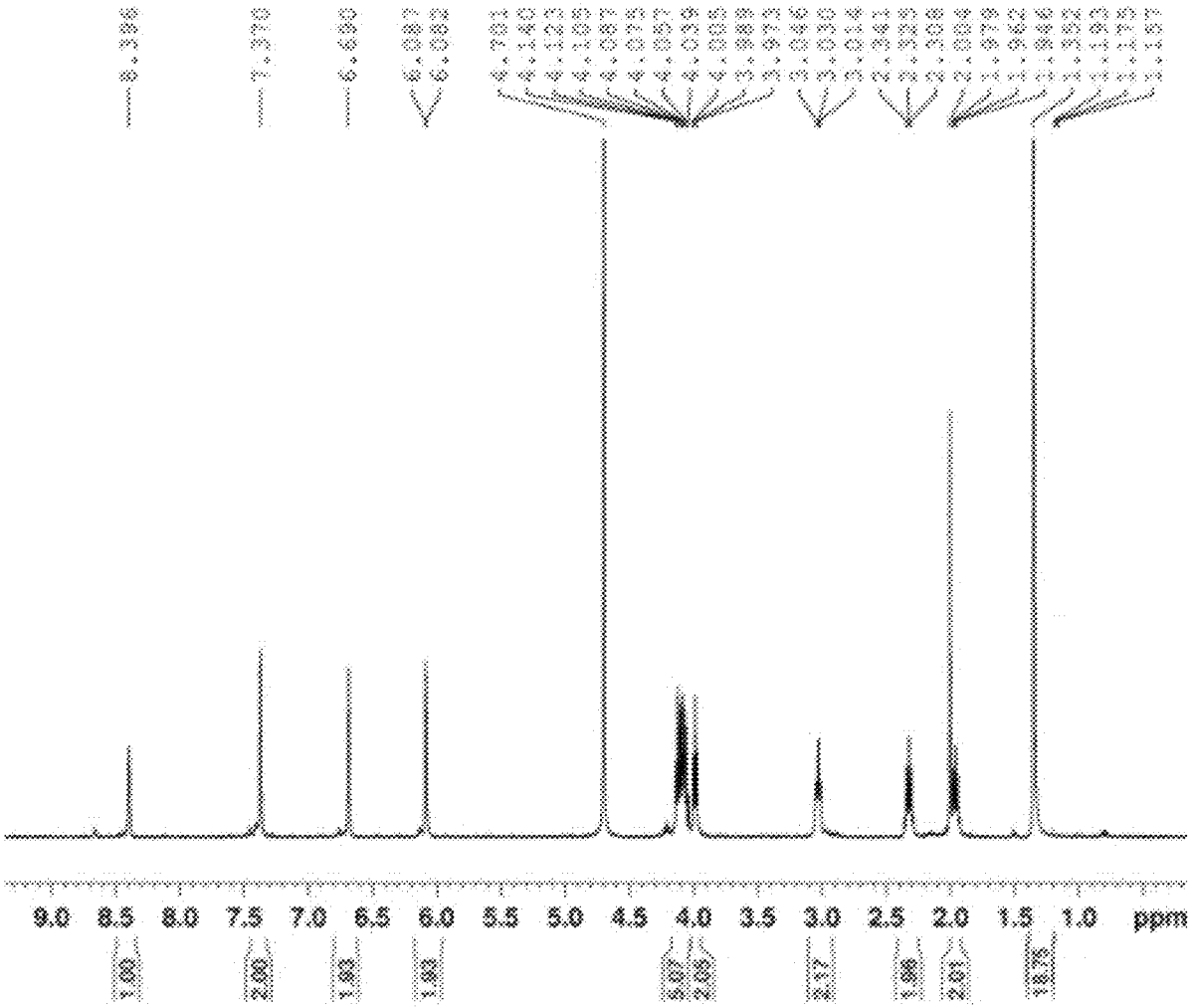
FIG. 2 shows the nuclear magnetic resonance spectrogram of 3-(12-bromo-dodecyl)-1-(3-pyrrol-propyl)-imidazole bromide.

The results thereof are shown as FIG. 2, the species and content of hydrogen in the molecule could be determined by the chemical displacement value and the integral of peak area in the spectrogram, so as to confirm the structure of the product is correct.

Embodiment 2

A preparation method for the gold nanoparticles based on the aforesaid functionalized ionic liquid, 3-(12-bromo-dodecyl)-1-(3-pyrrole-propyl)-imidazole bromide, comprising following steps of S1, seeded synthesis of gold nanoparticles: putting 0.42 mL of 0.002 mol/L HAuCl4 solution into 0.951 mL of secondary distilled water and blending to obtain a mixture, then adding 1.25 mL of 0.3 mol/L 3-(12-bromo-dodecyl)-1-(3-pyrrol-propyl)-imidazole bromide solution and 0.5 mL of new preparative 0.01 mol/L NaBH4 solution to the mixture for standing at 27° C. for 2 hours, thereby obtaining the gold nanoparticle seeds, and storing the gold nanoparticle seeds at 4° C. for later use;

S2, synthesis of gold nanoparticles: sequentially putting 2.6 mL of secondary distilled water, 1.67 mL of 2×10−3 mol/L HAuCl4 solution, 3.96 mL of 0.4~0.6 mol/L 3-(12-bromo-dodecyl)-1-(3-pyrrol-propyl) imidazole bromide solution and 54 μL of 0.1 mol/L ascorbic acid solution into the test tube and obtaining a mixture, and stirring the mixture vigorously for 2 minutes, lastly adding 120 μL of the gold nanoparticle seeds prepared in S1 to the mixture and stirring, after stirring the mixture for 20 seconds and standing the mixture for 24 hours at 27° C., thereby obtaining a gold nanoparticles solution.

S3, centrifuging the gold nanoparticles solution obtained in S2 at a rate of 12000 r/min for 10 minutes to divide the solution into two layers, removing the upper liquid layer, dispersing the lower solid layer to the water again and centrifuging the obtained gold nanoparticles again at a rate of 12000 r/min for 10 minutes to collect the gold nanoparticle solids, and after three times' centrifugation repeating washing the gold nanoparticles with water.

Figure 3:
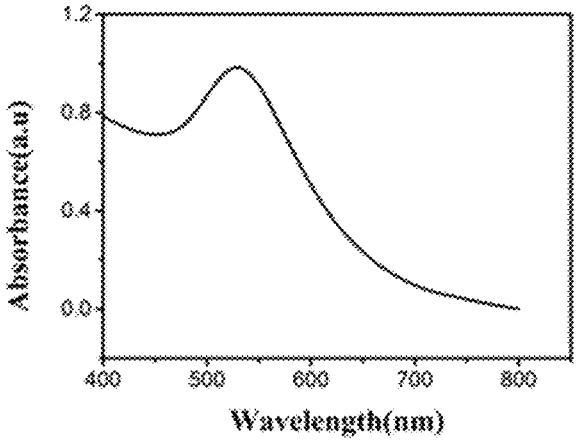
FIG. 3 shows the ultraviolet-visible absorption spectrogram of the gold nanoparticles prepared in the embodiment 2.

In the present invention, the ultraviolet-visible spectrum is employed to analyze the light absorption data of icosahedral gold nanoparticles in the range of 400~800 nm, in which the icosahedral gold nanoparticles are regulated and prepared by 3-(12-bromo-dodecyl)-1-(3-pyrrole-propyl)-imidazole bromide ionic liquid, and the specific steps are to disperse the gold nanoparticle solids prepared aforesaid to the water and put small amount of the gold nanoparticles solution in a 1 cm quartz cuvette. The results thereof are shown as FIG. 3. And according to the results in FIG. 3, the absorption peak of gold nanoparticles is at 525 nm.

Figure 4:
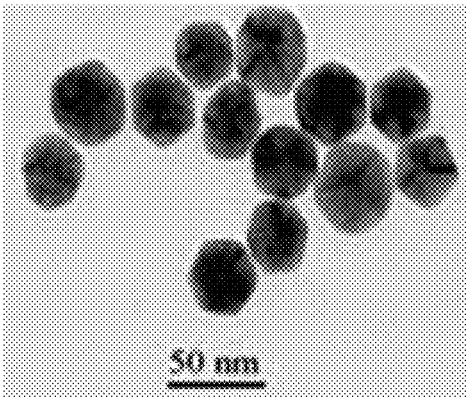
FIG. 4 shows the transmission electron microscopy of the gold nanoparticles prepared in the embodiment 2.

Further the transmission electron microscopy is employed to detect the morphology and particle size of the prepared gold nanoparticles and the results thereof are shown as FIG. 4. According to the results in the FIG. 4, the morphology of the gold nanoparticles prepared in the present embodiment is icosahedral, and the average particle size of the gold nanoparticles is 30 nm, and the gold nanoparticles exhibit a monodispersed state in the solution, consistent with the relationship between the UV absorption peak and the size reported in the literature.

Figure 5:
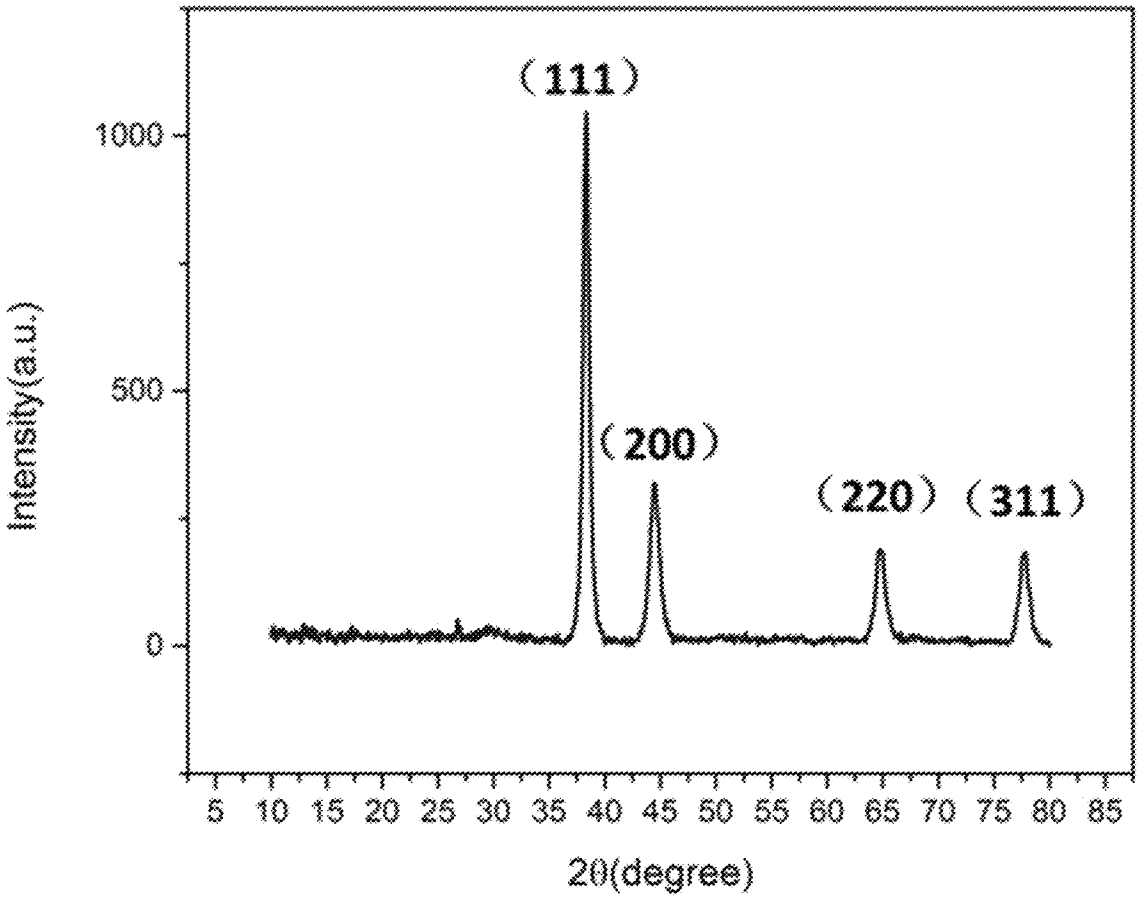
FIG. 5 shows the x-ray powder diffraction pattern of the gold nanoparticles prepared in the embodiment 2.

Further the X-ray diffraction is employed to record the crystal diffraction pattern of gold nanoparticles and the results thereof are shown as FIG. 5. According to the results in the FIG. 5, there are four characteristic diffraction peaks of gold nanoparticles, namely, when the diffraction angle 2θ thereof is respectively located at 38.40°, 44.49°, 64.91°, and 77.75°, the corresponding crystal face of gold atoms in a face-centered cube is (111). (200), (220), (311), matching with the standard powder diffraction spectrum of gold nanoparticles. It indicates that the preparation method in the present invention has successfully prepared the gold nanoparticle icosahedron. Meanwhile in FIG. 5 the (111) crystal face peak area is 2.5 times of (200) crystal surface peak area. It indicates that the gold nanoparticles synthesized in the present invention are rich in (111) crystal faces, providing a lot of active sites for the following research and biological protein fixation.

Embodiment 3

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in the NaBH4 solution added in S1 is stand for 4 hours at 27° C. to obtain the gold nanoparticles.

The rest are all the same as the embodiment 2.

Figure 6:
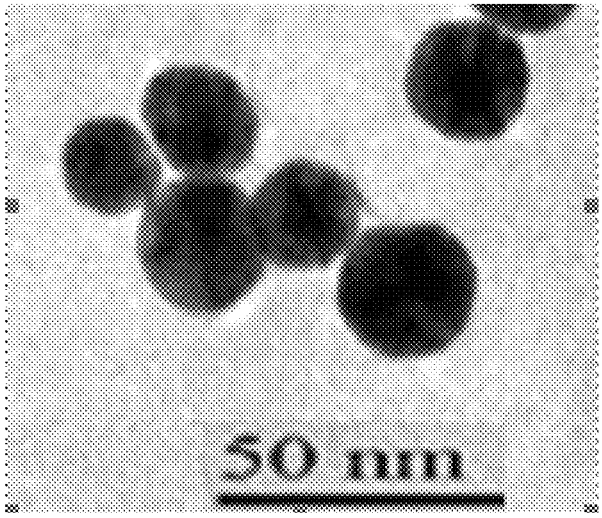
FIG. 6 shows the transmission electron microscopy of the gold nanoparticles prepared in the embodiment 3.

Further the transmission electron microscopy is employed to detect the morphology and particle size of the prepared gold nanoparticles and the results thereof are shown as FIG. 6. According to the FIG. 6, the morphology of the gold nanoparticles prepared in the present embodiment is icosahedral, the average particle size of the gold nanoparticles is 30 nm, and the gold nanoparticles exhibit a monodispersed state in the solution.

Embodiment 4

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in the concentration of the 3-(12-bromo-dodecyl)-1-(3-pyrrole-propyl)-imidazole bromide solution in S1 is 0.4 mol/L.

The rest are all the same as the embodiment 2.

Further the transmission electron microscopy is employed to detect the morphology and particle size of the prepared gold nanoparticles and the results show the morphology of the gold nanoparticles prepared in the present embodiment is icosahedral, the average particle size of the gold nanoparticles is 30 nm, and the gold nanoparticles exhibit a monodispersed state in the solution.

Embodiment 5

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in the concentration of the 3-(12-bromo-dodecyl)-1-(3-pyrrole-propyl)-imidazole bromide solution in Step 2 is 0.6 mol/L The rest are all the same as the embodiment 2.

Further the transmission electron microscopy is employed to detect the morphology and particle size of the prepared gold nanoparticles and the results show the morphology of the gold nanoparticles prepared in the present embodiment is icosahedral, the average particle size of the gold nanoparticles is 30 nm, and the gold nanoparticles exhibit a monodispersed state in the solution.

Embodiment 6

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in 150 μL of the gold nanoparticle seeds prepared in S1 is added in S2.

The rest are all the same as the embodiment 2.

Further the transmission electron microscopy is employed to detect the morphology and particle size of the prepared gold nanoparticles and the results show the morphology of the gold nanoparticles prepared in the present embodiment is icosahedral, the average particle size of the gold nanoparticles is 30 nm, and the gold nanoparticles exhibit a monodispersed state in the solution.

Embodiment 7

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in the standing time in S2 is 2 hours The rest are all the same as the embodiment 2.

Further the transmission electron microscopy is employed to detect the morphology and particle size of the prepared gold nanoparticles and the results show the morphology of the gold nanoparticles prepared in the present embodiment is icosahedral, the average particle size of the gold nanoparticles is 30 nm, and the gold nanoparticles exhibit a monodispersed state in the solution.

Comparative Embodiment 1

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in the concentration of the 3-(12-bromo-dodecyl)-1-(3-pyrrole-propyl)-imidazole bromide solution in S1 is 0.5 mol/L.

The rest are all the same as the embodiment 2.

Figure 7:
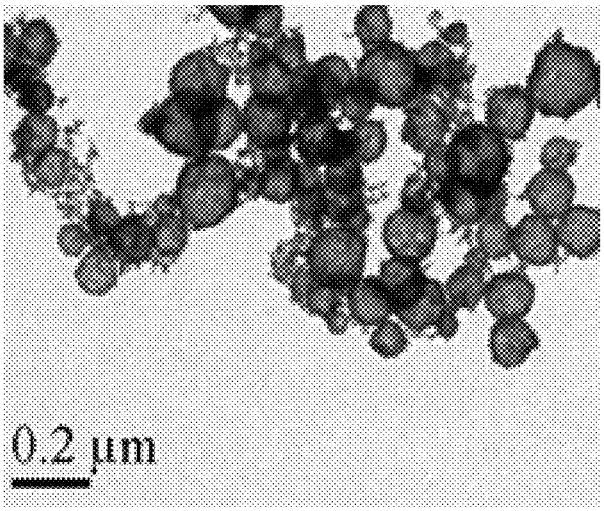
FIG. 7 shows the transmission electron microscopy of the gold nanoparticles prepared in the comparative embodiment 1.

Further the transmission electron microscopy is employed to detect the morphology and particle size of the prepared gold nanoparticles and the results are shown as FIG. 7. According to the results in FIG. 7, the morphology of the gold nanoparticles prepared in the present comparative embodiment, the morphology of the gold nanoparticles is in the shape of nanosphere, and the average particle size of gold nanoparticles is bigger than that prepared in the embodiment 2 of the present invention, and local agglomeration occurs in the gold nanoparticles.

Comparative Embodiment 2

The present embodiment provides a preparation method for gold nanoparticles based on aforesaid functionalized ionic liquid, 3-(12-bromo-dodecyl)-1-(3-pyrrole-propyl)-imidazole bromide. Compared with the embodiment 2, the difference of the present embodiment lies in the standing temperature in S2 is kept at 35° C. for 24 h.

The rest are all the same as the embodiment 2.

Figure 8:
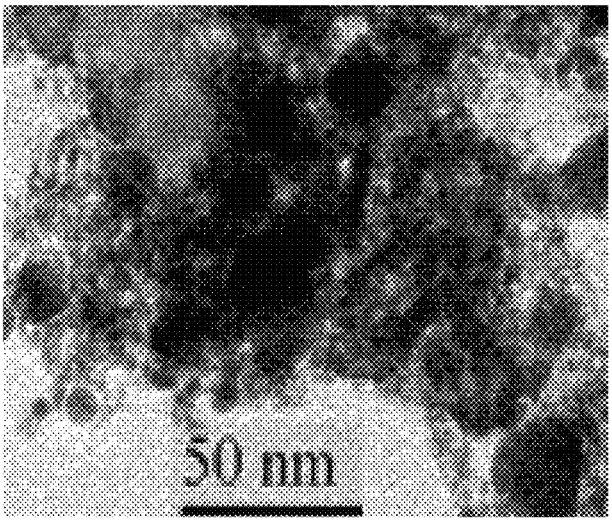
FIG. 8 shows the transmission electron microscopy of the gold nanoparticle produced in the comparative embodiment 2.

Further the transmission electron microscopy is employed to detect the morphology and particle size of the prepared gold nanoparticles and the results are shown as FIG. 8. According to the results in FIG. 8, the morphology of the gold nanoparticles prepared in the present comparative embodiment, the morphology of the gold nanoparticles is in the shape of nanosphere and severely reunited. It could be the excessive growth of the gold nanoparticles after the extension of the standing time, resulting in agglomeration, and indicates changing the growth time of gold nanoparticles will affect the morphology and particle size of gold nanoparticles.

After a large number of experiments, it is found that to change any of the parameters or methods in the experimental process of the present invention, the morphology and size of lastly prepared gold nanoparticles will be affected, indicating that only under the parameters of each step optimized by the present invention, the experimental results of the present invention could be achieved.

To sum up, in the present invention the imidazole group is substituted by dibromoalkanes to form a 3-(12-bromo-dodecyl)-1-(3-pyrrol-propyl)-imidazole bromide ionic liquid with one side chain thereof comprising bromine atom and the anion being bromine ion, in which the halogen ions play an important role in the regulation of gold nanoparticle morphology; The present invention employs the chloroauric acid as a precursor, the 3-(12-bromo-dodecyl)-1-(3-pyrrol-propyl)-imidazole bromide ionic liquid as a morphology regulator, and the ascorbic acid as a reducing agent. By means of adjusting the concentration of the Ionic liquid and the dosage of the reducing agent to certain amounts, and optimizing the reaction time, the icosahedral gold nanoparticles with uniform size is successfully prepared by seed growth method. The present invention provides a new idea for the functionalized ionic liquid as a stabilizer to modify the morphology of the noble metal nanoparticles and perform group modification on the surface of the noble metal nanoparticles, moreover the preparation method of the present invention is simple, green and environmentally friendly, and indicates a new development direction for the synthesis and regulation of metal morphology.

The foresaid are only illustrative embodiments of the present invention and are not restrictions on any form or substance of the invention. It should be pointed out that a number of improvements and additions made by those skilled in the art without departing from the method of the present invention are also considered to be the scope of protection of the present invention; Those skilled in the art, without departing from the spirit and scope of the present invention, make any equivalent changes in modification and evolution by making use of the above disclosed technical contents will be the equivalent embodiments of the present invention; At the same time, any equivalent changes, modifications and evolutions to the above embodiments in accordance with the essential techniques of the present invention will still fall within the scope of the invention.

What is claimed is:

1. A preparation method for gold nanoparticles, characterized in comprising the following steps of:

S1, a step of seeded synthesis of gold nanoparticles comprising: putting 0.42 mL of 0.002 mol/L HAuCl4 solution into 0.951 mL of secondary distilled water and blending to obtain a first mixture, then adding 1.25 mL of 0.20-0.40 mol/L 3-(12-bromo-dodecyl)-1-(3-pyrrol-propyl)-imidazole bromide solution and 0.5 mL of new preparative 0.01 mol/L NaBH4 solution to the first mixture, thereby providing a second mixture and standing the second mixture at 27° C. for 2-4 hours, thereby obtaining gold nanoparticle seeds, and storing the gold nanoparticle seeds at 4° C. for later use;

S2, a step of synthesis of gold nanoparticles comprising: sequentially putting 2.6 mL of secondary distilled water, 1.67 mL of 2×10−3 mol/L HAuCl4 solution, 3.96 mL of 0.4-0.6 mol/L 3-(12-bromo-dodecyl)-1-(3-pyrrol-propyl) imidazole bromide solution and 54 μL of 0.1 mol/L ascorbic acid solution into a test tube and obtaining a third mixture, and stirring the third mixture vigorously for 2 minutes, lastly adding 100-150 μL of the gold nanoparticle seeds prepared in S1 to the third mixture and then stirring the third mixture for 20-40 seconds, and then standing the third mixture for 12-24 hours at 25-30° C., thereby obtaining a gold nanoparticles solution; and S3, centrifuging the gold nanoparticles solution obtained in S2 to collect gold nanoparticle solids, then washing the gold nanoparticle solids with water and centrifuging again to collect the gold nanoparticle solids.

2. A preparation method for the gold nanoparticles of the claim 1, characterized in that the concentration of the 3-(12-bromo-dodecyl)-1-(3-pyrrol-propyl)-imidazole bromide solution in S1 is 0.25 mol/L.

3. A preparation method for the gold nanoparticles of the claim 1, characterized in that the concentration of the 3-(12-bromo-dodecyl)-1-(3-pyrrol-propyl)-imidazole bromide solution in S2 is 0.50 mol/L.

4. A preparation method for the gold nanoparticles of the claim 1, characterized in that 120 μL of gold nanoparticle seeds prepared in S1 is added in S2.

5. A preparation method for the gold nanoparticles of the claim 1, characterized in that the standing temperature in S2 is kept at 27° C. for 24 h to obtain the gold nanoparticles solution.

6. A preparation method for the gold nanoparticles of the claim 1, wherein the step of centrifuging the gold nanoparticles solution comprises centrifuging at a rate of 12000 r/min for 8-10 minutes to divide the gold nanoparticles solution into an upper liquid layer and a lower solid layer;

the upper liquid layer is removed and the lower solid layer comprises the gold nanoparticle solids collected from the centrifugation step; and the step of washing comprises dispersing into water the gold nanoparticle solids collected from the centrifugation step; and the step of centrifuging again comprises centrifuging the dispersion of water and gold nanoparticle solids obtained from the washing step to obtain the gold nanoparticle solids.

* * * * *